US006259007B1

(12) United States Patent
Stuart

(10) Patent No.: US 6,259,007 B1
(45) Date of Patent: Jul. 10, 2001

(54) MUSICAL INSTRUMENT POSITIONING DEVICE

(76) Inventor: Coleman Stuart, 24 John Stuart Rd., Hattiesburg, MS (US) 39402

( * ) Notice: Subject to any disclaimer, the term of this patent is extended or adjusted under 35 U.S.C. 154(b) by 0 days.

(21) Appl. No.: 09/475,979

(22) Filed: Dec. 30, 1999

(51) Int. Cl.[7] ..... G10D 1/12
(52) U.S. Cl. ..... 84/281; 84/327
(58) Field of Search ..... 84/281, 290, 327, 84/99; D17/99

(56) References Cited

U.S. PATENT DOCUMENTS

| | | | | |
|---|---|---|---|---|
| D. 302,435 | * | 7/1989 | Pearse | D17/20 |
| 672,444 | | 4/1901 | Haile . | |
| 1,342,202 | | 6/1920 | Cox . | |
| 1,945,162 | * | 1/1934 | Rasmussen | 84/0 |
| 2,547,924 | | 4/1951 | Citro . | |
| 2,814,229 | * | 11/1957 | Vaccaro | 84/327 |
| 4,084,477 | | 4/1978 | Dominguez . | |
| 4,656,917 | | 4/1987 | Van Halen . | |
| 5,388,492 | * | 2/1995 | Olson | 84/327 |
| 5,616,874 | * | 4/1997 | Kraus et al. | 84/327 |
| 5,817,961 | * | 10/1998 | Beck | 84/327 |
| 6,031,167 | * | 2/2000 | Gaston | 84/327 |

FOREIGN PATENT DOCUMENTS

| | | | | |
|---|---|---|---|---|
| 677043 | | 3/1991 | (CH) . | |
| 3923870A | * | 1/1991 | (DE) | 84/327 |
| 2579812A | * | 10/1986 | (FR) | 84/327 |
| 41712 | | 8/1925 | (NO) . | |

OTHER PUBLICATIONS

Kensett's Improved Device of Holding Violins in Position, Jan. 1892.*

* cited by examiner

*Primary Examiner*—Bentsu Ro
*Assistant Examiner*—Kim Lockett
(74) *Attorney, Agent, or Firm*—Stephen R. Greiner

(57) ABSTRACT

A device for positioning a musical instrument such as a guitar, banjo or mandolin at a predetermined distance from a player's torso so as to improve the instrument's tone. The device includes an arcuate body with a pair of musical instrument-gripping arms affixed to the opposed ends of the arcuate body. A pair of resilient mats are affixed to the concave surface of the arcuate body adjacent each arm. A pair of resilient pads are affixed to the arms so as to overlap the adjacent mat.

6 Claims, 1 Drawing Sheet

FIG. 1
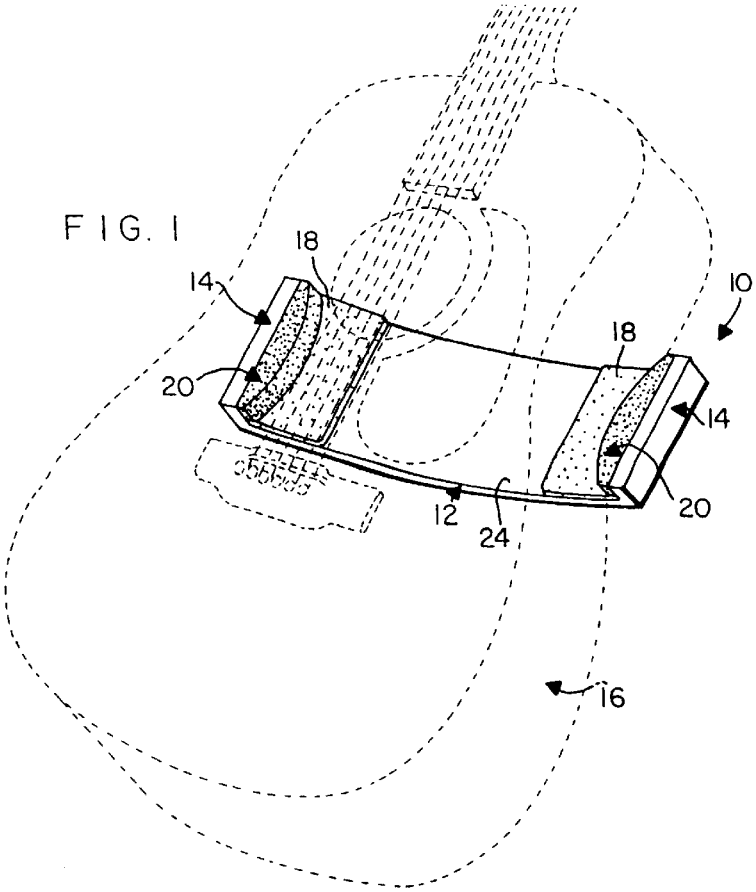
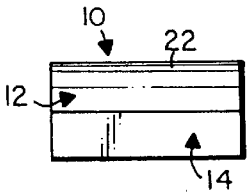
FIG. 4
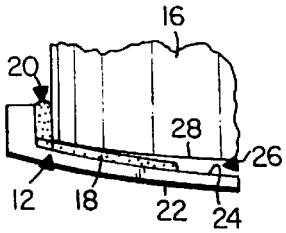
FIG. 5
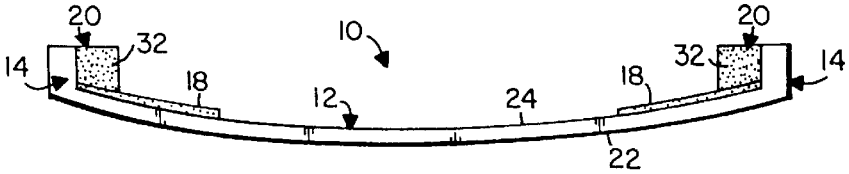
FIG. 2
FIG. 3
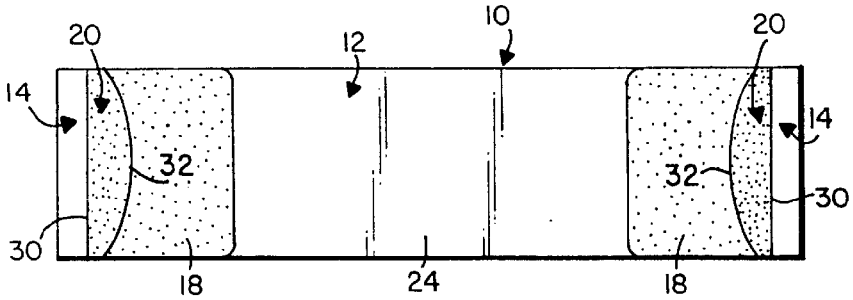

MUSICAL INSTRUMENT POSITIONING DEVICE

FIELD OF THE INVENTION

The present invention relates generally to musical instruments and, more particularly, to accessories used therewith.

BACKGROUND OF THE INVENTION

It is accepted practice for a standing musician to rest the back of an acoustic guitar against his torso while performing. The area of contact with the back of the guitar may be large or small depending upon the stature and playing technique of the guitarist. Regardless, it has been found that any contact of this sort tends to reduce the resonance of the guitar and degrade its tone.

Holding the guitar away from the torso while performing for a prolonged period of time leads to fatigue and, ultimately, poor musicianship. Some have proposed stands and holders of various sorts to reduce such fatigue. As a group, these devices have been difficult to use and, for this reason, have not seen widespread acceptance among serious musicians.

SUMMARY OF THE INVENTION

In light of the problems associated with the known devices for holding a musical instrument adjacent a user, it is a principal object of the invention to provide a positioning device of uncomplicated construction which may be releasably attached to a musical instrument such as an acoustic guitar, mandolin or banjo for retaining the instrument at a predetermined distance from the torso of a user. The device improves the tone of the instrument to which it is attached and prolongs the instrument's life by separating such from damaging buttons, buckles, and the like worn by users.

It is another object of the invention to provide a positioning device of the type described which can be easily attached and detached from a musical instrument without special tools or training and without marring the instrument.

It is an object of the invention to provide improved elements and arrangements thereof in a musical instrument positioning device for the purposes described which is lightweight in construction, inexpensive to manufacture, and dependable in use.

Briefly, the musical instrument positioning device in accordance with this invention achieves the intended objects by featuring an arcuate body with a pair of musical instrument-gripping arms at its opposed ends. A pair of felt mats are affixed to the concave surface of the arcuate body adjacent each arm. A pair of foam pads are affixed to the arms so as to overlap and slidably engage the felt mats.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a perspective view of a musical instrument positioning device in accordance with the present invention shown secured to an acoustic guitar.

FIG. 2 is a top view of the positioning device of FIG. 1.

FIG. 3 is a front view of the positioning device.

FIG. 4 is an end view of the positioning device.

FIG. 5 is a partial side view of the positioning device showing compression of a gripping pad when brought into contact with a side of a musical instrument.

Similar reference characters denote corresponding features consistently throughout the accompanying drawings.

DETAILED DESCRIPTION OF THE PREFERRED EMBODIMENT

Referring now to the FIGS., a musical instrument positioning device in accordance with the present invention is shown at 10. Device 10 includes an arcuate body 12 with a pair of musical instrument-gripping arms 14 extending outwardly from its opposed ends. Arms 14 are spaced from one another so as to grip the opposite sides of a musical instrument like guitar 16. Mats 18 on body 12 and pads 20 on arms 14 prevent the marring of guitar 16 by device 10 during use.

Arcuate body 12 is formed from a wood like mahogany, known for its durability, light weight, musical resonance and resilience. Body 12 measures about 13.5 inches (34 cm) in length, 3.5 inches (9 cm) in width, and 0.375 inches (1 cm) in thickness from its convex side 22 to its concave side 24. To produce a stand-off 26 of about 0.75 inches (2 cm) between concave side 24 and the flat back 28 of guitar 16, body 12 is has a radius of curvature on the order of 24 inches (61 cm).

Arms 14 are formed of mahogany blocks approximately 3.5 inches (9 cm) long, 0.625 inches (1.6 cm) tall, and 0.5 inches (1.3 cm) wide which are adhesively secured to concave side 24 of body 12. If desired, however, arms 14 could be integrally formed with body 12 to avoid seams. Such a construction would be most practical if body 12 and arms 14 were molded from plastic or other material.

A pair of mats 18 are adhesively secured to the concave surface 24 of body 12 adjacent arms 14. Mats 18 comprise pieces of felt cloth measuring about 2.5 inches (6.4 cm) in length by 3.5 inches (9 cm) in width by 0.0625 inches (0.16 cm) in thickness. Alternatively, mats 18 could be combined as a single unit extending from one arm 14 to the other arm 14 along concave surface 24.

Pads 20 are formed of a soft foam material and extend the length and height of arms 14 and are about 0.75 inches (2 cm) thick at their thickest point. As shown, pads 20 have a D-shaped outline with a flat surface 30 on one side and a rounded surface 32 on the other. The flat surface 30 of each pad 20 is adhesively secured to the inner surfaces of arms 14. Rounded surfaces 32 face one another from opposite ends of body 12.

Pads 20 "float" above mats 18 with their bottom surfaces positioned in slidable engagement therewith. Thus, when pads 20 are compressed by guitar 16 toward arms 14 without binding as shown if FIG. 5, portions of mats 18 are always available adjacent arms 14 to separate body 12 from guitar 16 and reduce the likelihood of scratching and other damage.

Use of device 10 is straightforward. First, guitar 16 is held as shown in FIG. 1 with its top facing a user. Next, a pad 20 carried by one arm 14 is pressed against a side of guitar 16, compressing the pad 20 slightly. (Note: device 10 is dimensioned to span guitar 16 at its waist. Of course, device 10 may be dimensioned to engage the body of guitar 16 elsewhere.) The other pad 20 is, then, pressed into engagement with the opposite side of guitar 16. By releasing device 10, pads 20 center body 12 adjacent the waist of guitar 16. Guitar 16 may now be moved against the torso of a user for playing in the usual manner.

With device 10 positioning guitar 16 away from a user's torso, guitar 16 will have an improved tone when played and guitar 16 will receive less damage from sharp objects worn by the user. Arcuate body 12 also serves to absorb some shocks, by flexing slightly, that would otherwise be imparted to guitar 16. When the user has finished making music, device 10 is slid from guitar 16 and stored for reuse at a later time.

While the invention has been described with a high degree of particularity, it will be appreciated by those skilled in the art that modifications may be made thereto. For example, separate mats 18 or pads 20 may be omitted from embodiments of device 10 where body 12 and arms 14 are made from soft materials. Therefore, it is to be understood that the present invention is not limited to the sole embodiment described above, but encompasses any and all embodiments within the scope of the following claims.

I claim:

1. A musical instrument positioning device, comprising:

an arcuate body having opposed ends;

a pair of musical instrument-gripping arms each being respectively integrally formed with one of said opposed ends of said arcuate body; and, a pair of resilient pads each being respectively affixed to one of said instrument-gripping arms for snug engagement with the sides of a musical instrument.

2. A musical instrument positioning device, comprising:

an arcuate body having a concave surface with opposed ends;

a pair of musical instrument-gripping arms each being respectively affixed to one of said opposed ends of said concave surface of said arcuate body;

a pair of resilient mats each being affixed to said concave surface adjacent a respective one of said musical instrument-gripping arms; and, a pair of resilient pads each being respectively affixed to one of said musical instrument-gripping arms and overlapping an adjacent one of said resilient mats for snug engagement with the sides of a musical instrument.

3. The positioning device according to claim 2 wherein each of said pair of mats is in abutment with one of said musical instrument-gripping arms.

4. The positioning device according to claim 2 wherein each of said resilient pads has a D-shaped outline with a flat surface secured to a respective one of said musical instrument-gripping arms and with a rounded surface opposite said flat surface for snugly engaging a musical instrument.

5. A musical instrument positioning device, comprising:

an arcuate body having a concave surface for positioning adjacent a musical instrument and an opposed convex surface for positioning against the torso of a user, said arcuate body also having opposed ends;

a pair of musical instrument-gripping arms each being respectively affixed to one of said opposed ends of said arcuate body;

a pair of felt mats each being affixed to said concave surface adjacent a respective one of said musical instrument-gripping arms; and, a pair of foam pads each being respectively affixed to one of said musical instrument-gripping arms as well as slidably engaging and overlapping an adjacent one of said resilient mats.

6. The positioning device according to claim 5 wherein each of said resilient pads has a D-shaped outline with a flat surface secured to a respective one of said musical instrument-gripping arms and with a rounded surface opposite said flat surface for snugly engaging a musical instrument.

* * * * *